US008226217B2

(12) United States Patent
Montz et al.

(10) Patent No.: US 8,226,217 B2
(45) Date of Patent: Jul. 24, 2012

(54) DYNAMIC PHASE SHIFTS TO IMPROVE STREAM PRINT

(75) Inventors: Kim W. Montz, Webster, NY (US); Todd R. Griffin, Webster, NY (US); David L. Jeanmaire, Brockport, NY (US); Robert Link, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 430 days.

(21) Appl. No.: 12/613,683

(22) Filed: Nov. 6, 2009

(65) Prior Publication Data

US 2011/0109677 A1 May 12, 2011

(51) Int. Cl.

| | |
|---|---|
| ***B41J 2/07*** | (2006.01) |
| ***B41J 29/38*** | (2006.01) |
| ***B41J 2/15*** | (2006.01) |
| ***B41J 2/12*** | (2006.01) |

(52) U.S. Cl. ..... 347/74; 347/9; 347/11; 347/41; 347/78

(58) Field of Classification Search ..... 347/9, 11, 347/14, 40, 41, 47, 73–78
See application file for complete search history.

(56) References Cited

U.S. PATENT DOCUMENTS

| | | | | |
|---|---|---|---|---|
| 5,224,843 | A | 7/1993 | van Lintel | |
| 6,474,784 | B1 | 11/2002 | Fujii et al. | |
| 6,554,410 | B2 | 4/2003 | Jeanmaire et al. | |
| 6,561,627 | B2 | 5/2003 | Jarrold et al. | |
| 6,575,566 | B1 | 6/2003 | Jeanmaire et al. | |
| 6,588,888 | B2 | 7/2003 | Jeanmaire et al. | |
| 7,261,396 | B2 * | 8/2007 | Hawkins et al. | 347/74 |
| 7,651,206 | B2 * | 1/2010 | Hawkins et al. | 347/73 |
| 2008/0231669 | A1 | 9/2008 | Brost | |

FOREIGN PATENT DOCUMENTS

| | | |
|---|---|---|
| EP | 1 323 531 | 7/2007 |

OTHER PUBLICATIONS

R. C. Brost, "Aerodynamic Error Reduction for Liquid Drop Emitters", U.S. Appl. No. 11/687,873, filed Mar. 19, 2007.
K. W. Montz, "Phase Shifts for Printing at Two Speeds", U.S. Appl. No. 12/613,699, filed Nov. 6, 2009.
K. W. Montz, "Phase Shifts for Two Groups of Nozzles", U.S. Appl. No. 12/613,712, filed Nov. 6, 2009.

* cited by examiner

*Primary Examiner* — Ryan Lepisto
*Assistant Examiner* — Hung Lam
(74) *Attorney, Agent, or Firm* — Peyton C. Watkins

(57) ABSTRACT

A method of forming print drops includes forming drops of a first size by applying drop forming energy pulses during a unit time period, $\tau_0$; forming drops of a second size by applying drop forming energy pulses during a second drop time period, $\tau_m$, wherein the second drop time period is a multiple, m, of the unit time period, $\tau_m=m*\tau_0$, $m\geqq 2$; providing timing between drops for printing consecutive pixels is $\tau_i=a*\tau_0$ where a is an integer$\geqq$m; forming non-print drops and print drops according to the liquid pattern data; delaying the timing of the pulses for the drop forming energy pulses sent to the drop forming transducers of group number g relative to the drop forming energy pulses sent to the transducers of a first group by a delay time $\tau_L$, where $\tau_L=g*(INT(a/n)+1/n)*\tau_0+\tau_b$ where g is an integer<n.

11 Claims, 9 Drawing Sheets

DYNAMIC PHASE SHIFTS TO IMPROVE STREAM PRINT

CROSS REFERENCE TO RELATED APPLICATIONS

Reference is made to commonly assigned U.S. patent application Ser. No. 12/613,712 filed Nov. 6, 2009 by Kim Montz et. al., entitled "PHASE SHIFTS FOR TWO GROUPS OF NOZZLES", and commonly assigned U.S. patent application Ser. No. 12/613,699 filed Nov. 6, 2009 by Kim Montz et. al., entitled "PHASE SHIFTS FOR PRINTING AT TWO SPEEDS."

FIELD OF THE INVENTION

The present invention generally relates to digitally controlled printing devices and more particularly to continuous inkjet printheads that have improved quality at "low speeds" by phase shifting adjacent nozzles.

BACKGROUND OF THE INVENTION

Ink jet printing has become recognized as a prominent contender in digitally controlled, electronic printing because of its non-impact, low-noise characteristics, its use of plain paper and its avoidance of toner transfer and fixing. Ink jet printing mechanisms can be categorized by technology as either drop-on-demand ink jet or continuous ink jet.

The first technology, "drop-on-demand" ink jet printing, provides ink droplets that impact upon a recording surface by using a pressurization actuator (thermal, piezoelectric, etc.). Many commonly practiced drop-on demand technologies use thermal actuation to eject ink droplets from a nozzle. A heater, located at or near the nozzle, heats the ink sufficiently to boil, forming a vapor bubble that creates enough internal pressure to eject an ink droplet. This form of ink jet is commonly termed "thermal ink jet (TIJ)." Other known drop on-demand droplet ejection mechanisms include piezoelectric actuators, such as that disclosed in U.S. Pat. No. 5,224,843, issued to van Lintel, on Jul. 6, 1993; thermo-mechanical actuators, such as those disclosed by Jarrold et al., U.S. Pat. No. 6,561,627, issued May 13, 2003; and electrostatic actuators, as described by Fujii et al., U.S. Pat. No. 6,474,784, issued Nov. 5, 2002.

The second technology, commonly referred to as "continuous" ink jet printing, uses a pressurized ink source that produces a continuous stream of ink from a nozzle. The stream is perturbed in some fashion causing it to break up into drops in a controlled manner. Typically the perturbations are applied at a fixed frequency to cause the stream of liquid to break up into substantially uniform sized drops at a nominally constant distance, a distance called the break-off length, from the nozzle. A charging electrode structure is positioned at the nominally constant break-off point so as to induce a data-dependent amount of electrical charge on the drop at the moment of break-off. The charged droplets are directed through a fixed electrostatic field region causing each droplet to deflect proportionately to its charge. The charge levels established at the break-off point cause drops to travel to a specific location on a recording medium (print drop) or to a gutter for collection and recirculation (non-print drop).

An alternate type of continuous ink jet is described in U.S. Pat. No. 6,588,888 entitled "Continuous ink-jet printing method and apparatus," issued to Jeanmaire, et al. (Jeanmaire '888, hereinafter) and U.S. Pat. No. 6,575,566 entitled "Continuous inkjet printhead with selectable printing volumes of ink," issued to Jeanmaire, et al. (Jeanmaire '566 hereinafter) disclose continuous ink jet printing apparatus including a droplet forming mechanism operable in a first state to form droplets having a first volume traveling along a path and in a second state to form droplets having a plurality of other volumes, larger than the first, traveling along the same path. A droplet deflector system applies force to the droplets traveling along the path. The force is applied in a direction such that the droplets having the first volume diverge from the path while the larger droplets having the plurality of other volumes remain traveling substantially along the path or diverge slightly and begin traveling along a gutter path to be collected before reaching a print medium. The droplets having the first volume, print drops, are allowed to strike a receiving print medium whereas the larger droplets having the plurality of other volumes are "non-print" drops and are recycled or disposed of through an ink removal channel formed in the gutter or drop catcher.

In preferred embodiments, the means for variable drop deflection comprises air or other gas flow. The gas flow affects the trajectories of small drops more than it affects the trajectories of large drops. Generally, such types of printing apparatus that cause drops of different sizes to follow different trajectories, can be operated in at least one of two modes, a small drop print mode, as disclosed in Jeanmaire '888 or Jeanmaire '566, and a large drop print mode, as disclosed also in Jeanmaire '566 or in U.S. Pat. No. 6,554,410 entitled "Printhead having gas flow ink droplet separation and method of diverging ink droplets," issued to Jeanmaire, et al. (Jeanmaire '410 hereinafter) depending on whether the large or small drops are the printed drops. The present invention described herein below are methods and apparatus for implementing either large drop or small drop printing modes.

The combination of individual jet stimulation and aerodynamic deflection of differently sized drops yields a continuous liquid drop emitter system that eliminates the difficulties of previous CIJ embodiments that rely on some form of drop charging and electrostatic deflection to form the desired liquid pattern. Instead, the liquid pattern is formed by the pattern of drop volumes created through the application of input liquid pattern dependent drop forming pulse sequences to each jet, and by the subsequent deflection and capture of non-print drops. An additional benefit is that the drops generated are nominally uncharged and therefore do not set up electrostatic interaction forces amongst themselves as they traverse to the receiving medium or capture gutter.

This configuration of liquid pattern deposition has some remaining difficulties when high-speed, high pattern quality printing is undertaken. High speed and high quality liquid pattern formation requires that closely spaced drops of relatively small volumes are directed to the receiving medium. As the pattern of drops traverse from the printhead to the receiving medium, through a gas flow deflection zone, the drops alter the gas flow around neighboring drops in a pattern-dependent fashion. The altered gas flow, in turn, causes the printing drops to have altered, pattern-dependent trajectories and arrival positions at the receiving medium. In other words, the close spacing of print drops as they traverse to the receiving medium leads to aerodynamic interactions and subsequent drop placement errors. These errors have the effect of spreading an intended printed liquid pattern in an outward direction and so are termed "splay" errors herein.

US Published Patent Application US 20080231669 (Brost '669 hereafter) discloses a method for improving image quality of continuous inkjet printing at high speeds by eliminating the splay errors of the prior art.

While Brost '669 is effective at improving the print quality at high speeds, it has been found that the print quality is not improved at all print speeds. In particular, at low and medium print speeds, print defects are still apparent. The present invention provides a method of improving printing quality at all speeds other than maximum speed.

SUMMARY OF THE INVENTION

The present invention is directed to overcoming one or more of the problems set forth above. Briefly summarized, according to one aspect of the invention, the invention resides in a method of forming a liquid pattern of print drops impinging a receiving medium according to liquid pattern data using a liquid drop emitter that emits a plurality of continuous streams of liquid from a plurality of nozzles arranged into n groups; where n is an integer greater than 1 and less than 10 and the nozzles of each group are interleaved with nozzles of each other group such that a nozzle of each other group lies between adjacent nozzles of any given group and the nozzles are disposed along a nozzle array direction, each of the continuous streams of liquid are broken into a plurality of drops having a first and second size drop by a corresponding plurality of drop forming transducers to which a corresponding plurality of drop forming energy pulses are applied, the method comprising: (a) forming drops of a first size by applying drop forming energy pulses during a unit time period, $\tau_0$; (b) forming drops of a second size by applying drop forming energy pulses during a second drop time period, $\tau_m$, wherein the second drop time period is a multiple, m, of the unit time period, $\tau_m=m*\tau_0$, and $m\geqq 2$; (c) providing timing between drops for printing consecutive pixels is equal to $\tau_i=a*\tau_0$, where a is an integer$\geqq$m and is a function of print media speed; (d) forming the corresponding plurality of drop forming energy pulses sequences so as to form non-print drops and print drops according to the liquid pattern data; (e) delaying the timing of the pulses for the drop forming energy pulses sent to the drop forming transducers of group number g relative to the drop forming energy pulses sent to the transducers of a first group by a delay time $\tau_L$, where an approximate value of $\tau_L=g*(INT(a/n)+1/n)*\tau_0$ where g is a specific group of interest which starts a zero for the first group.

These and other objects, features, and advantages of the present invention will become apparent to those skilled in the art upon a reading of the following detailed description when taken in conjunction with the drawings wherein there is shown and described an illustrative embodiment of the invention.

ADVANTAGEOUS EFFECT OF THE INVENTION

The present invention has the advantage of improving image quality at all print speeds other than maximum speed.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1:
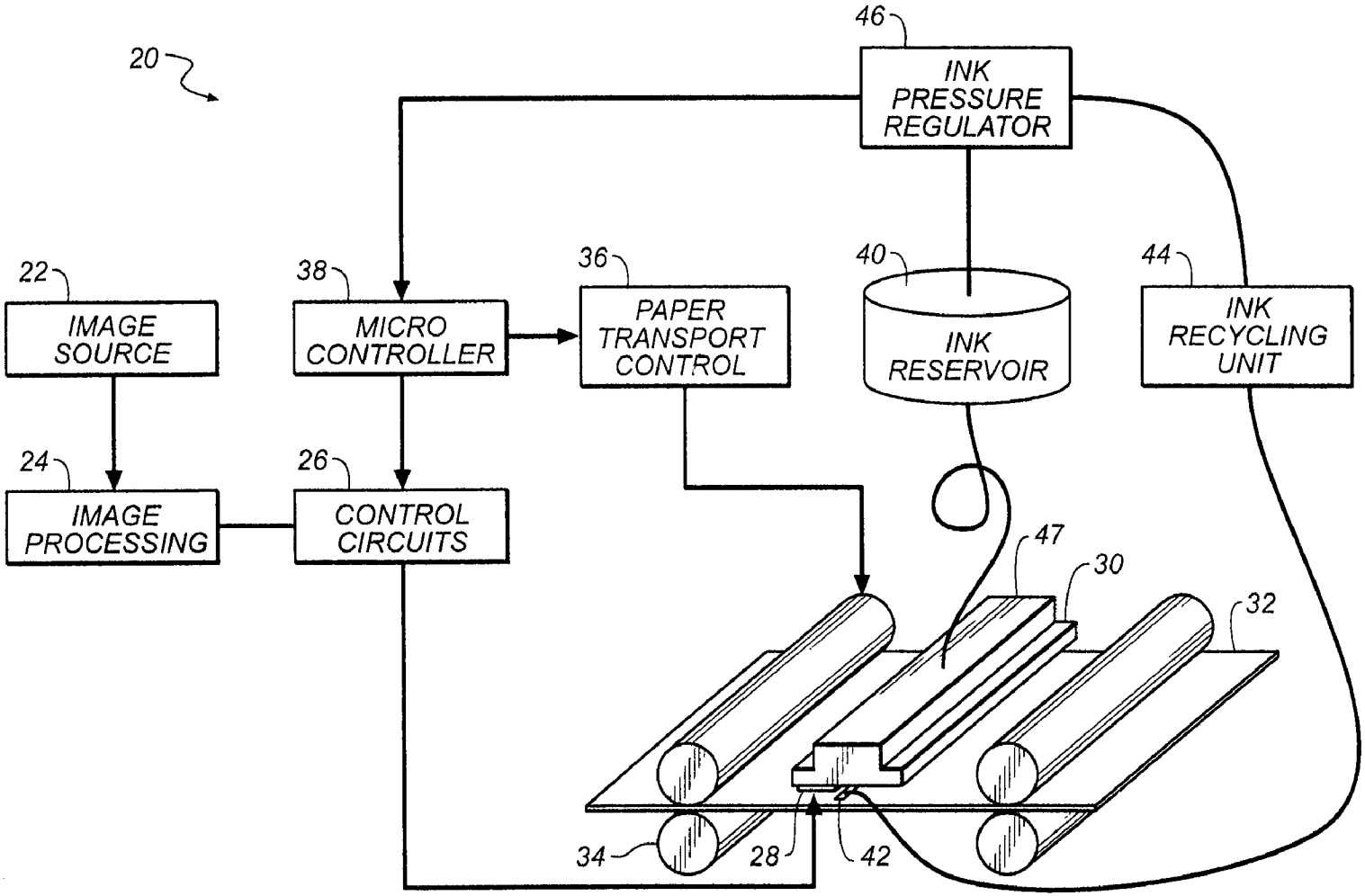
FIG. 1 shows a simplified block schematic diagram of an example embodiment of a printer system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous ink jet printer system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and applies time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
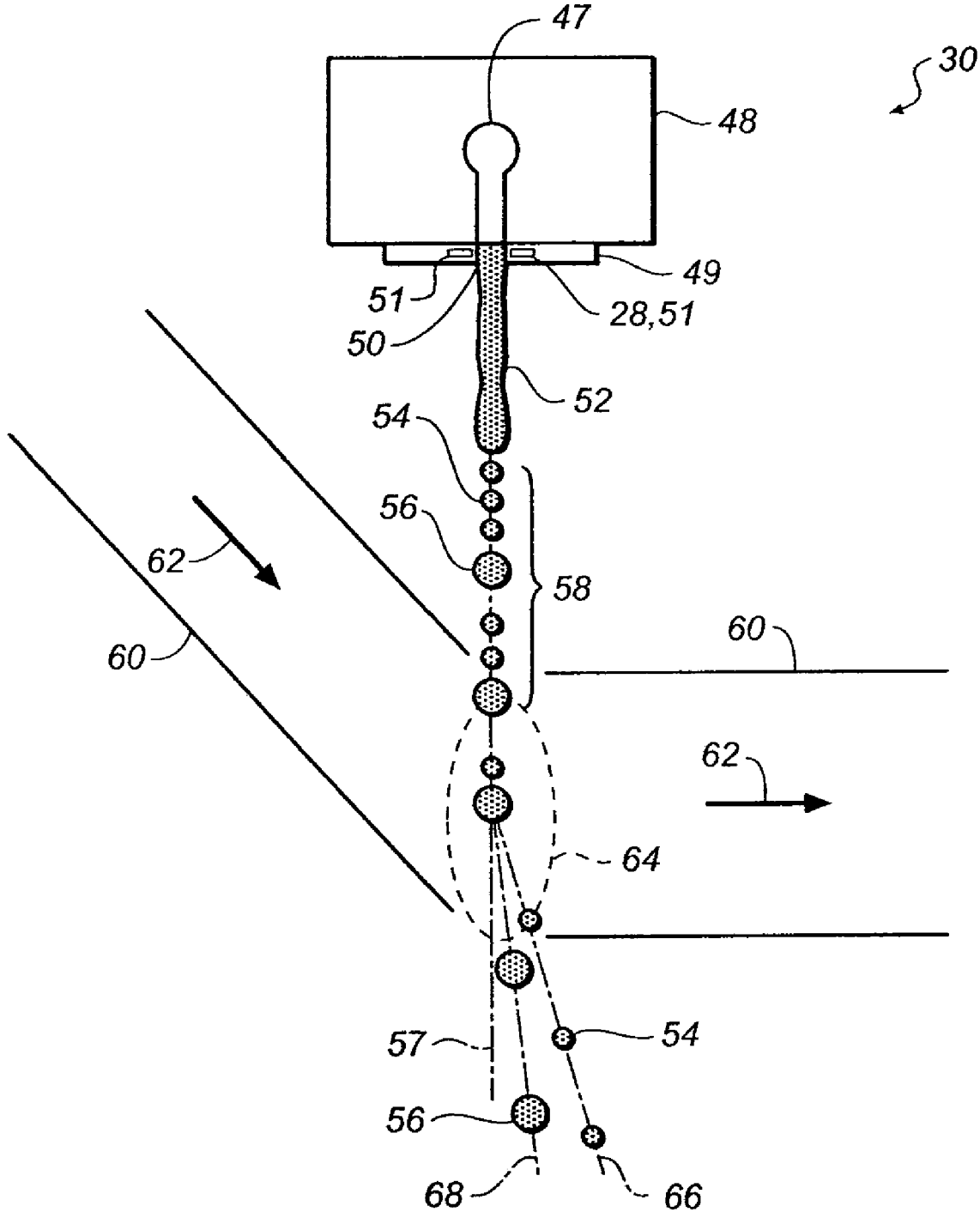
FIG. 2 is a schematic view of an example embodiment of a continuous printhead made in accordance with the present invention.

Referring to FIG. 2, a schematic view of a continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, if preferred, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure and preferably the nozzle array is a linear array of nozzles.

Jetting module 48 is operable to form liquid drops having a first size and liquid drops having a second size through each nozzle. To accomplish this, jetting module 48 includes a drop stimulation or drop forming device or transducer 28, for example, a heater, piezoelectric transducer, EHD transducer and a MEMS actuator, that, when selectively activated, perturbs each filament of liquid 52, for example, ink, to induce portions of each filament to breakoff from the filament and coalesce to form drops 54, 56.

In FIG. 2, drop forming device 28 is a heater 51 located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes, for example, in the form of large drops 56, a first size, and small drops 54, a second size. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIG. 1) can be positioned to intercept the small drop trajectory 66 so that drops following this trajectory are collected by catcher 42 while drops following the other trajectory bypass the catcher and impinge a recording medium 32 (shown in FIG. 1).

When catcher 42 is positioned to intercept small drop trajectory 66, large drops 56 are deflected sufficiently to avoid contact with catcher 42 and strike the print media. When catcher 42 is positioned to intercept small drop trajectory 66, large drops 56 are the drops that print, and this is referred to as large drop print mode.

Figure 3:
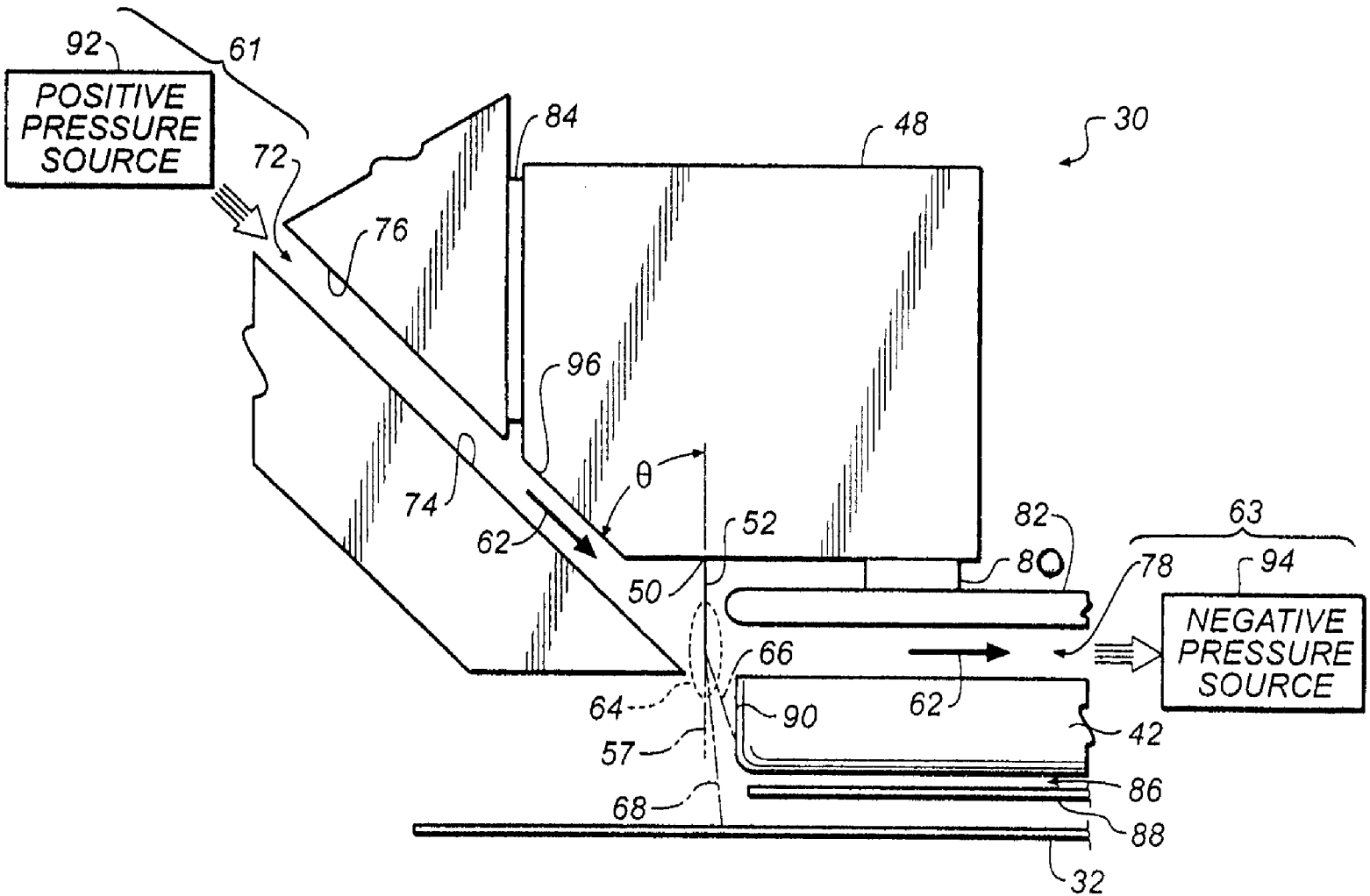
FIG. 3 is a schematic view of a simplified gas flow deflection mechanism of the present invention.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 80 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 80 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4:
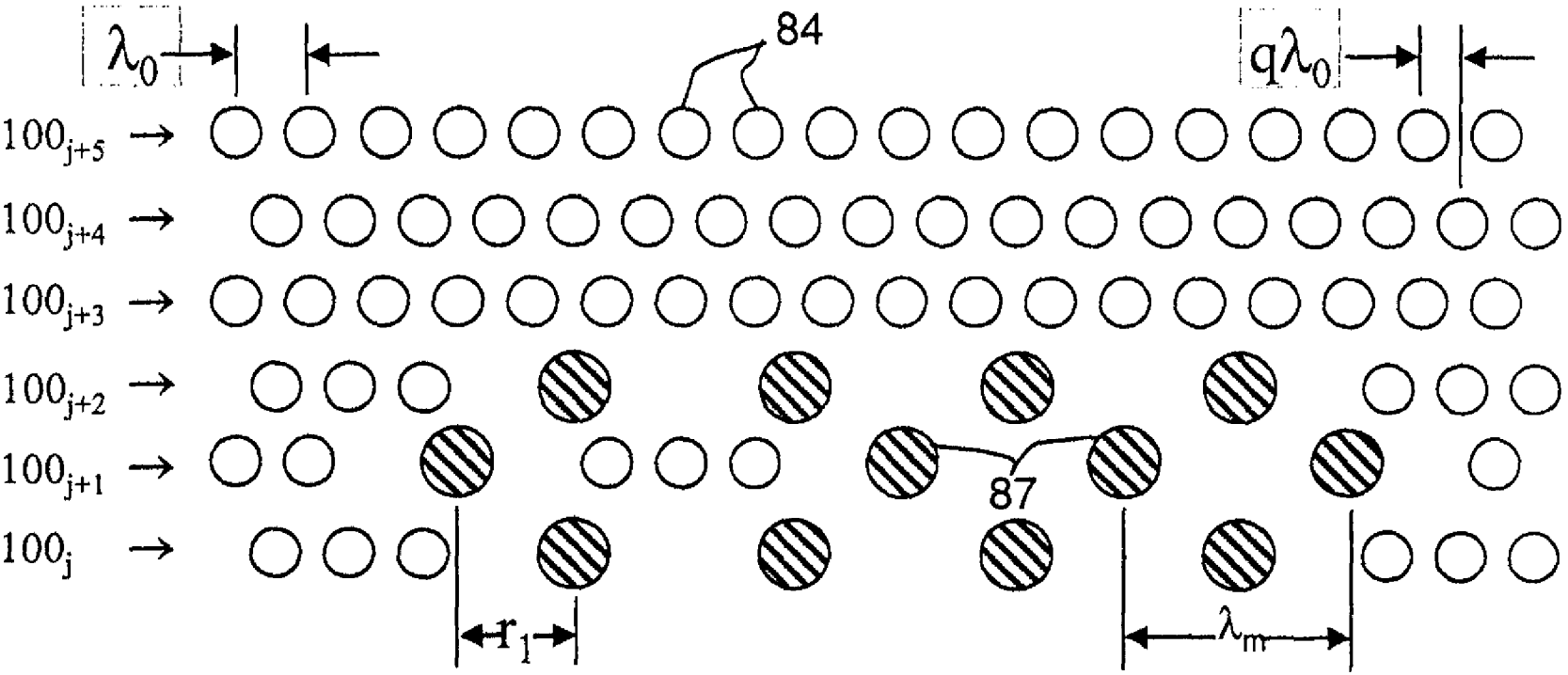
FIG. 4 is an ink drop pattern of the present invention illustrating large and small drops at high print speed.

According to Brost '669 certain print defects can be eliminated or reduced significantly by modifying the drop creation process for the array of nozzles so that timing shift or phase delay between the drop forming energy pulses of adjacent nozzles. This is illustrated in FIG. 4 which shows a portion of the streams of drops 100 produced by an array of nozzles. Each row of drops corresponds to a stream of drops that broke off from a liquid stream flow from one nozzle in the nozzle array. The streams of drops have been labeled $\mathbf{100}_j$ to $\mathbf{100}_{j+5}$. As discussed above, the drop forming device associated with a nozzle is operable to form liquid drops having a first size and liquid drops having a second size through each nozzle. In this figure, drops 84 are the drops of the first size and drops 87 are drops of the second size. Drops 87 have approximately three times the volume or mass of drops 84. While a drop volume ratio of three is shown in this figure, in general the volume of the drops of the second size is approximately m times the volume of the drops of the first size; where m is an integer greater than or equal to two.

Figure 5:
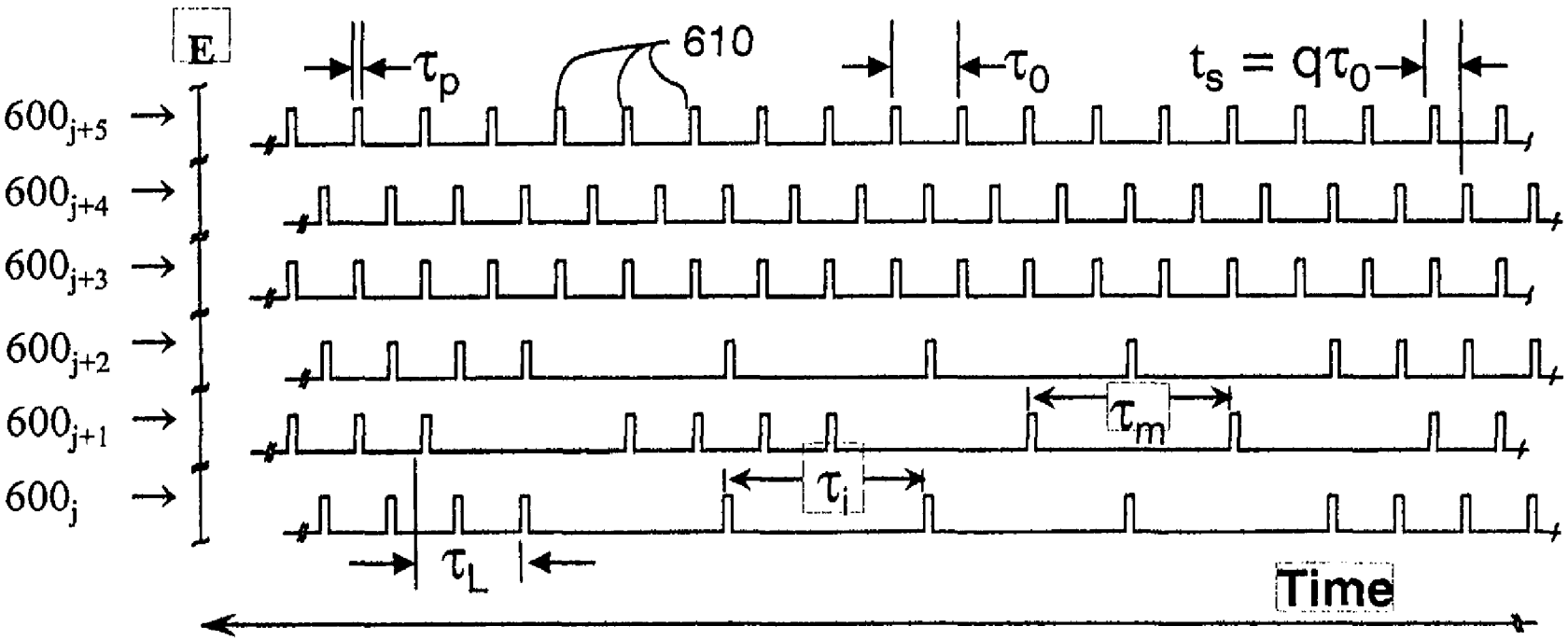
FIG. 5 is a pulse train for creating the drop pattern of FIG. 4.

The drops of the first and second sizes are formed by altering the time between drop-forming energy pulses applied to the liquid flowing through a nozzle. When the time from one drop forming energy pulse to the preceding pulse is $\tau_0$, a drop of the first size is created. The time $\tau_0$ is referred to herein as the unit time period and is shown in FIG. 5, and corresponds to a unit spatial period $\lambda_0$ as shown in FIG. 4. The unit spatial period in the space domain is a spatial distance between small drops. The time from one drop forming energy pulse to the preceding pulse is $\tau_m$, where $\tau_m = m*\tau_0$, a drop of the second size is created.

FIG. 4 shows a portion of an array of drops that have separated from respective liquid streams (not shown, off the left side of the figure). The drops are traveling from left to right. Each row of drops is formed from the stream of liquid flowing from a corresponding nozzle in the nozzle array in response to energy pulse applied by the drop forming device associated with that nozzle. This portion of the array of drops is located between the point at which they break off from the individual streams of liquid 52 and the point at which the non-print drops strike the catcher 90 as seen in FIG. 3. The view in FIG. 4 corresponds to looking at the array of drops from the left in FIG. 3. (The catcher 90 and the air duct walls 74 and 82 are not shown in FIG. 4 to enable the drops to be seen.) Drops 84 are drops of a first size. Drops 87 are drops of a second size. The drops of a second size have a drop volume that is approximately m times the volume of the drops of the first size; where m is an integer and m is greater than or equal to two. In the illustrated embodiment m is three; drops 87 have three times the volume of drops 84. Consecutive drops 84 of the first size are spaced apart by a distance $\lambda_0$, the unit spatial period. Consecutive drops 87 of the second size are spaced apart by a distance $\lambda_m$. The distance $\lambda_m$ is m times the distance $\lambda_0$; in this illustration, $\lambda_m$ is three times $\lambda_0$. Brost '669 disclosed that introducing a spatial shift between drops of adjacent nozzle, as they are in flight toward the print media, by a distance $r_1$ produced a significant reduction in splay. The shift distance $r_1$ disclosed therein is equal to one half of $\lambda_m$. For the illustrated embodiment where $\lambda_m$ is equal to three times $\lambda_0$, the spatial shift distance $r_1$ is equal to 1½ times $\lambda_0$. (As all the drops of the first size 84 look the same the spatial shift distance ½$\lambda_0$ between the drops in row 100 $j$+5 and the drops of row 100 $j$+4, the apparent shift is only ½$\lambda_0$ even though the actual shift for drops of the second size is 1½ times $\lambda_0$).

FIG. 5 shows the drop forming pulse pattern applied to the drop forming devices associated with the nozzles that produced the array of drops illustrated in FIG. 4. Each of the pulse trains 600 are associated with the drop forming device that formed the corresponding row of drops in FIG. 4. Each of the pulses 610 applied to a drop forming device causes a drop to form from the liquid stream associated with that drop forming device. When a pulse 610 lags behind the preceding pulse by a time $\tau_0$, it will produce a drop of the first size. When a pulse 610 lags behind the preceding pulse by a time $\tau_m$ that equals m times $\tau_0$, it produces a drop of the second size which is typically used as the print drop.

To produce the spatial shift of drops of adjacent nozzles, a phase shift is introduced into the drop forming pulse train of the adjacent nozzles. For example, the pulse train for 600 $j$+1 has been delayed by a phase shift of $\tau_L$ relative to pulse train 600$j$. In a similar way, all pulse trains 600$j$+ odd number are delayed by a phase shift $\tau_L$ relative to the pulse trains 600$j$+ even number. As taught by Brost, the phase shift $\tau_L$ is approximately ½ $\tau$m.

While this method is effective to reducing splay, when printing at high speeds the print quality is satisfactory, but at low speeds, the print quality has been found to be degraded. Even though production printing is carried out at printing at high speeds, low speed printing is frequently used for tuning the print operation. The degradation of quality at low speeds can then adversely affect the ability to tune the printing system. The present invention overcomes this problem.

To understand the present invention, it should be understood the difference between printing at high speeds and printing at low speeds. Referring to FIG. 4 which shows a pattern of print and catch drops for printing at high print speeds, at these high print speeds the time between drops created to print consecutive pixels $\tau_i$ is equal to the time between drop forming pulses required to create a print drop $\tau_m$.

Figure 6A:
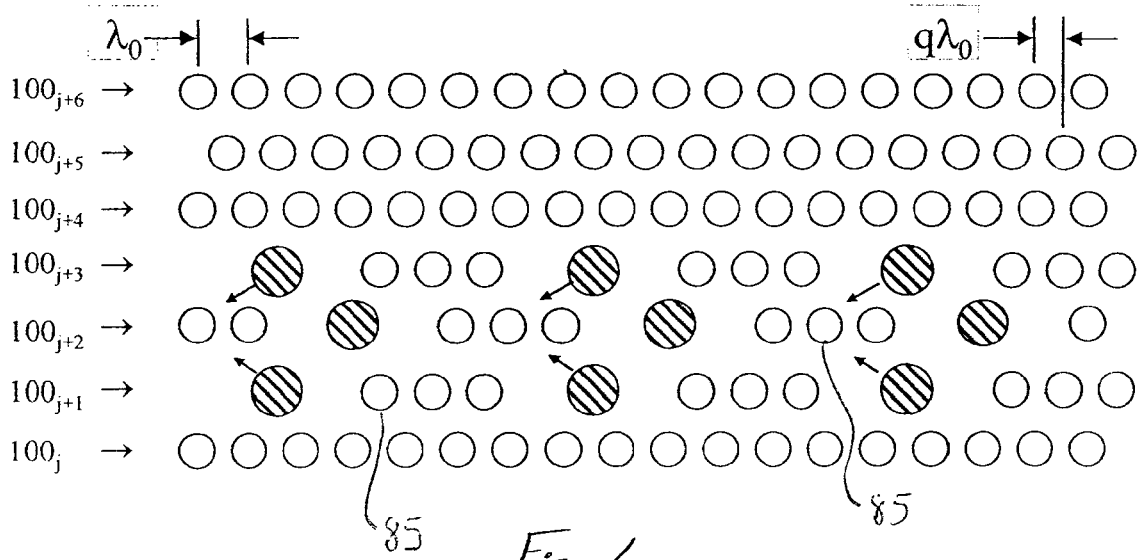
Fig. 6a Prior Art
FIG. 6*a* is a prior art ink drop pattern at a first low print speed.
Figure 6B:
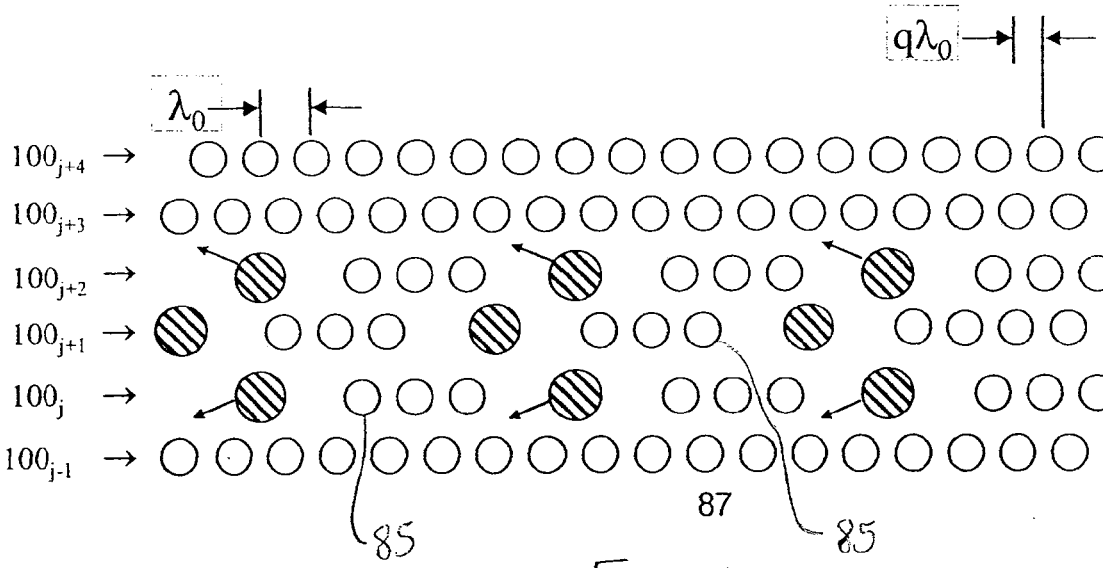
Fig. 6b Prior Art
FIG. 6*b* is a prior art ink drop pattern at a first low print speed, with print pattern shifted to different drop streams

Considering FIGS. 6*a* and 6*b* which correspond to prior art printing at a lower print speed, at this print speed the time between drops to print consecutive pixels $\tau_i$ is greater than the time between drop forming pulses to create a print drop $\tau_m$. To properly space the print drops so that they land on desired pixels, it becomes necessary to insert non-print (catch) drops 85 between drops of consecutive pixels. When printing at still lower print speeds, even more non-print (catch) drops 85 are inserted between print drops of consecutive pixels. The presence of the catch drops between the print drops for consecutive pixels alters the air flow around the print drops. When printing as the method in Brost at lower speeds, the air drag on the outer drops in a three pixel wide mark causes those drops to diverge if they lead the center drop, but they converge if they were lagging the center drop as indicated by the arrows in FIGS. 6*a* and 6*b*.

Figure 7:
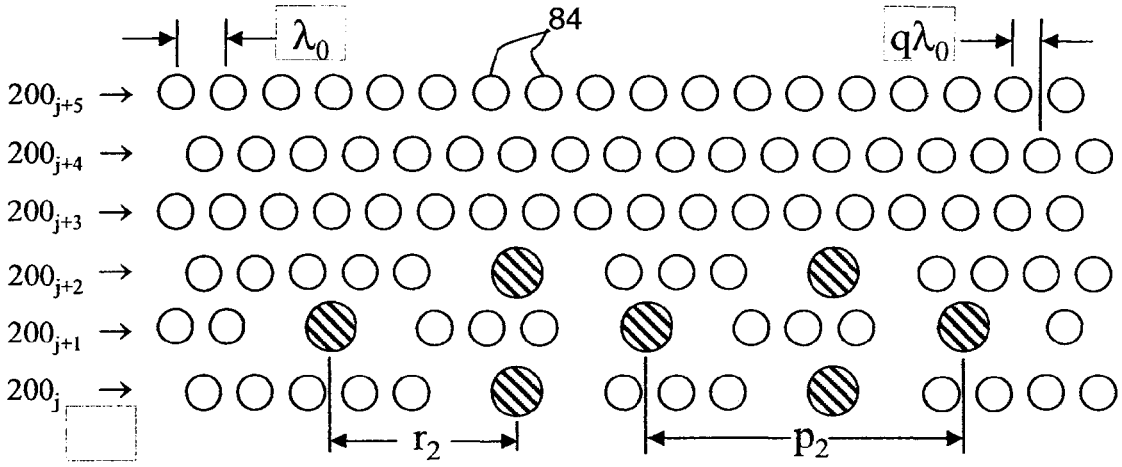
FIG. 7 is an ink drop pattern of the present invention at a first low speed.
Figure 9:
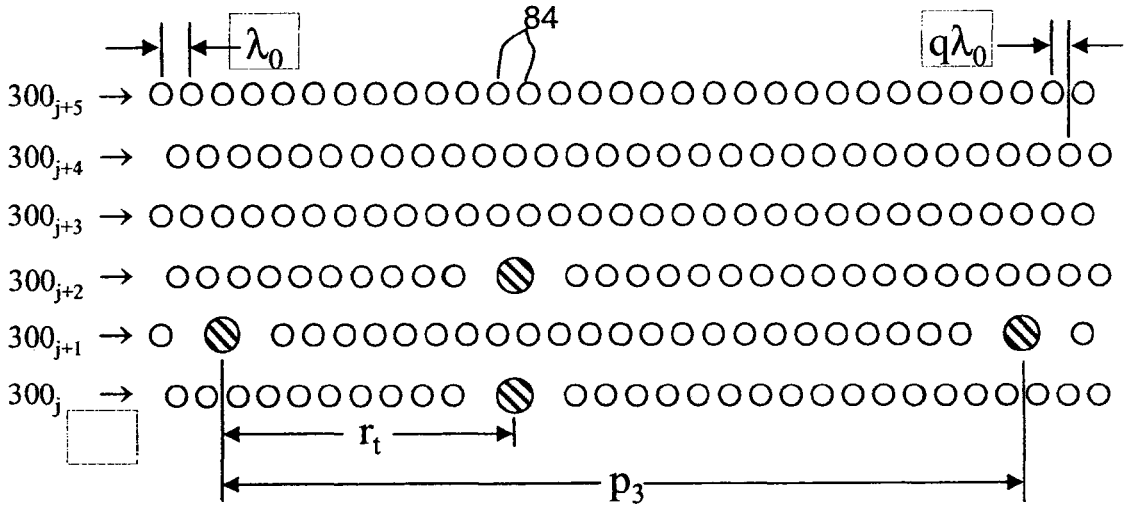
FIG. 9 is an ink drop pattern of the present invention at a second low speed.
Figure 8:
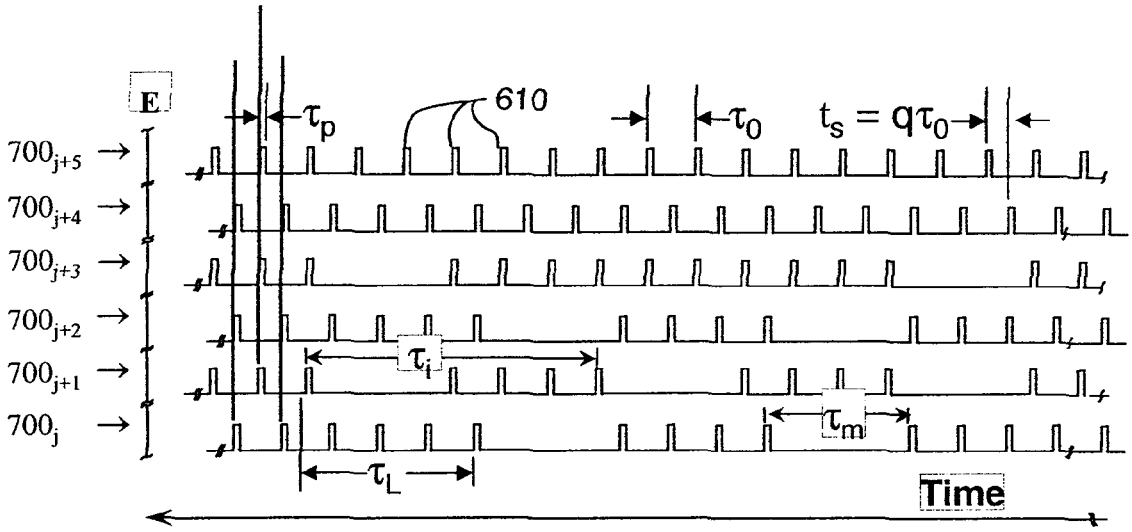
FIG. 8 is a pulse train for creating the ink drop pattern of FIG. 7.
Figure 10:
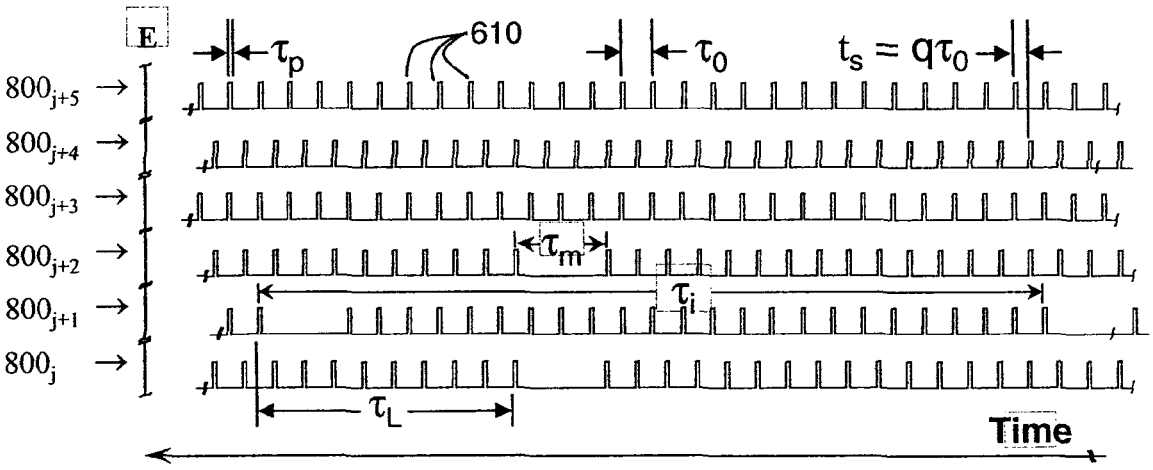
FIG. 10 is a pulse train for creating the ink drop pattern of FIG. 9.

In regards to the present invention, FIGS. 8 and 10 are the corresponding pulse train diagrams used to produce the drop patterns shown in FIGS. 7 and 9. Referring back to FIGS. 8 and 10, the time between creation of drops of consecutive pixels $\tau_i$ is greater than the time between drop forming pulses to create the print drops $\tau_m$. The time $\tau_i$ is measured in terms of the number of unit time periods $\tau_0$, where $\tau_i = a*\tau_0$ and a is an integer. When printing at full speed, a is equal to m, and when printing at lower speeds, a is greater than m. To overcome the shortcomings of Brost in printing at lower speeds, the present invention uses a different delay time $\tau_L$.

It has been found that rather than using a fixed $\tau_L$; $\tau_L$ dynamically changes in response to the print speed so that $\tau_L$ is approximately $\tau_i/2$ when $\tau_i$ is greater than $\tau_m$, where a is greater than m. Maintaining $\tau_L$ at approximately $\tau_i/2$ for two groups of nozzles, the value of $\tau_L$ is a general guideline for maximizing the distance between drops of a second size in adjacent nozzles. Other factors such as image quality, runnability, and system constraints may be used to limit, constrain or optimize $\tau_L$ as a function of web speed.

For example:

1) In making $\tau_L$ approximately $\tau_i/2$, it helps to avoid the air dynamic drag problems seen by the Brost method while constraining the value $\tau_L$ in ½ integers helps to stabilize the air flow around adjacent drops and can reduce cross talk.

2) It has been found that at extremely slow speeds at which a>20 that no further benefit is gained by increasing the delay time $\tau_L$ beyond $9\frac{1}{2}\times\tau_0 \pm$ the bias amount $\tau_b$ or, in other words, $\tau_L < 10\times\tau_0$.

Using these guidelines, $\tau_L$ may be approximately equal to one of 1½, 2½, 3½, 4½, 5½, 6½, 7½, 8½, 9½ times $\tau_0$. An alternative to dynamically adjusting $\tau_L$ across many different steps is to create a custom table of $\tau_L$ (one or multiple values from the list in the preceding sentence) for slower print speeds. Print quality will improve with even one additional $\tau_L$ for slower speed printing as long conforms to the following equation: mathematically, $\tau_m/2 < \tau_L \leqq \tau_i$.

Furthermore, it is optional to shift the delay slightly away from the ½ integer value by a bias amount $\tau_b$, where $\tau L_b$ is greater than $0.05\times\tau_0$ and less than $0.5\times\tau_0$.

Mathematically, $\tau_m/2 \leqq \tau_L \leqq \tau_i$. Mathematically for maximum drop separation, $\tau_L$ can be written as:

$$\tau_L = (\mathrm{INT}(a/2)+\tfrac{1}{2})*\tau_0 \pm \tau_b \qquad \text{Eq. 1}$$

Although the present invention describes having two groups of nozzles 50, the nozzles of FIG. 2, may have n groups of nozzles, where n is greater than one and less than 10. In this case, the time delay of each adjacent group of nozzles 50 is $\tau_L$, where an approximate value of $\tau_L = g*(\mathrm{INT}(a/n)+1/n)*\tau_0+\tau_b$ where g is an integer (wherein the first group starts at zero) representing the specific group of interest and where $\tau_b$ is optional. The same general guidelines as for two groups of nozzles also apply to n groups of nozzles.

Figure 11:
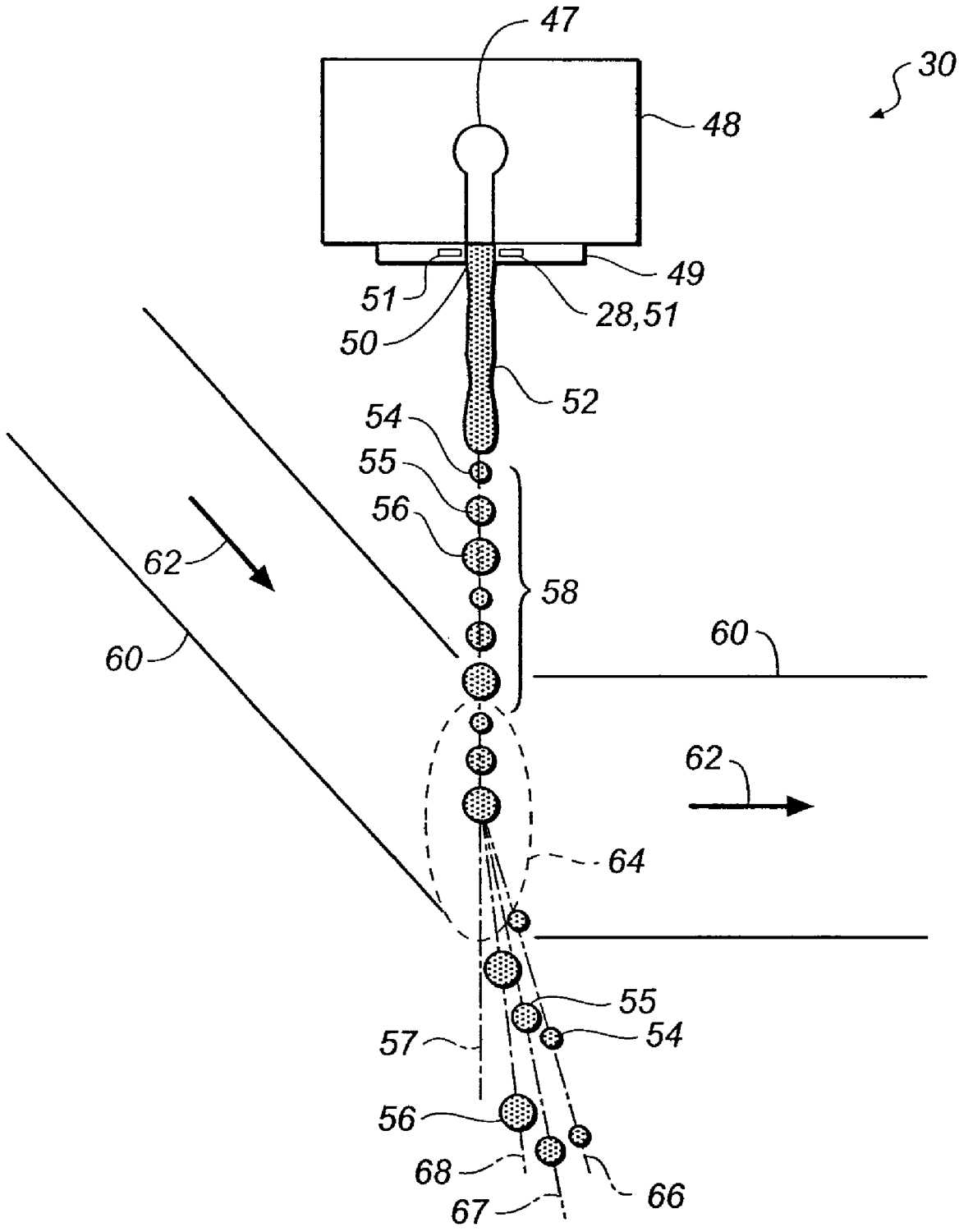
FIG. 11 is an alternative embodiment of FIG. 2.

Still further, the ink drop pattern of the present invention may have three ink sizes, each of a different size. Referring to FIG. 11, there is a third size ink drop 55 in the drop stream 58 which is larger than drop 54 but smaller than drop 56.

In this case, the drop trajectory 67 of the third size (medium drop size) drop 55 is between the small trajectory drop 66 and large drop trajectory 68. As in the case of the small drop 54 and large drop 56, the flow of gas 62 causes the third size drop to have a deflection angle relative to drop trajectory 57. The third drop size time period is $\tau_q = d*\tau_0$ and d is greater than 1 and less than m, where m is greater than or equal to 3. The third size drop will also impinge upon the receiving medium 32.

According to the method described above, the delay time is varied as a function of the print speed. To minimize fluctuations back and forth between two delay times in response to apparent speed changes above and below a transition print speed, it is beneficial to filter the print media speed measurements. The filter may include clipping the measured speed readings so that measured speed readings above a high speed threshold amount are replaced with the threshold value. Similarly, measured speed readings below a low speed threshold are replaced with the low speed threshold value. The filter may also include using a multi-point moving average after the step of clipping the speed measurements to reduce apparent speed fluctuations. These filtering steps are typically done in software or in the firmware of a field-programmable gate array. While this filtering has proved beneficial, it is anticipated other filtering methods may also be used.

The invention has been described in detail with particular reference to certain preferred embodiments thereof, but it will be understood that variations and modifications can be effected within the spirit and scope of the invention.

PARTS LIST

20 continuous ink jet printer system
22 image source
24 image processing unit
26 mechanism control circuits
28 drop forming mechanism
30 printhead
32 recording medium
34 recording medium transport system
36 recording medium transport control system
38 micro-controller
40 reservoir
42 catcher
44 recycling unit
46 pressure regulator
47 channel

48 jetting module
49 nozzle plate
50 plurality of nozzles
51 heater
52 liquid
54 drops
55 drops
56 drops
57 trajectory
58 drop stream
60 gas flow deflection mechanism
61 positive pressure gas flow structure
62 gas
63 negative pressure gas flow structure
64 deflection zone
66 small drop trajectory
67 medium trajectory
68 large drop trajectory
72 first gas flow duct
74 lower wall
76 upper wall
78 second gas flow duct
80 optional seal(s)
82 upper wall
84 (catch) drops
85 (catch) drops
86 liquid return duct
87 drops
88 plate
90 front face
92 positive pressure source
94 negative pressure source
96 wall
100 streams of drops
600 pulse trains
610 pulses

The invention claimed is:

1. A method of forming a liquid pattern of print drops impinging a receiving medium according to liquid pattern data using a liquid drop emitter that emits a plurality of continuous streams of liquid from a plurality of nozzles arranged into n groups; where n is an integer greater than 1 and less than 10 and the nozzles of each group are interleaved with nozzles of each other group such that a nozzle of each other group lies between adjacent nozzles of any given group and the nozzles are disposed along a nozzle array direction, each of the continuous streams of liquid are broken into a plurality of drops having a first and second size drop by a corresponding plurality of drop forming transducers to which a corresponding plurality of drop forming energy pulses are applied, the method comprising:

(a) forming drops of a first size by applying drop forming energy pulses during a unit time period, $\tau_0$, (b) forming drops of a second size by applying drop forming energy pulses during a second drop time period, $\tau_m$, wherein the second drop time period is a multiple, m, of the unit time period, $\tau_m=m*\tau_0$, and $m\geqq 2$;

(c) providing timing between drops for printing consecutive pixels is equal to $\tau_i=a*\tau_0$, where a is an integer$\geqq$m and is a function of print media speed;

(d) forming the corresponding plurality of drop forming energy pulses sequences so as to form non-print drops and print drops according to the liquid pattern data;

(e) delaying the timing of the pulses for the drop forming energy pulses sent to the drop forming transducers of group number g relative to the drop forming energy pulses sent to the transducers of a first group by a delay time $\tau_L$, where an approximate value of $\tau_L=g*(INT(a/n)+1/n)*\tau_0$ where g is a specific group of interest which starts a zero for the first group.

2. The method as in claim 1, wherein the nozzle array is a linear array of nozzles.

3. The method as in claim 1 further comprising the step of providing third sized drops by applying drop forming energy pulses during a third drop size time period and the third drop size time period is $\tau_q=q*\tau_0$ and q is greater than 1 and less than m, where m is greater than or equal to 3.

4. The method as in claim 1, wherein the approximate value of $\tau_i/2$ comprises $\tau_L$=ti/2 plus or minus a bias amount equal to or less than $\tau_0/2$.

5. The method as in claim 2, wherein the approximate value of $\tau_L=g*(INT(a/n)+1/n)*\tau_0$ plus or minus a bias amount equal to or less than $\tau_0/2$.

6. The method as in claim 5, wherein n=2.

7. The method as in claim 1, wherein $\tau_L<10*\tau_0$.

8. The method as in claim 1, wherein the second sized drops serve as print drops.

9. The method as in claim 4, wherein the bias amount$>0.05*\tau_0$.

10. The method as in claim 1, wherein the drop forming transducers are one or more of the following: a heater, piezoelectric transducer, EHD transducer and a MEMS actuator.

11. The method as in claim 5 wherein the bias amount$>0.05*\tau_0$.

* * * * *